United States Patent [19]

Evans et al.

[11] Patent Number: 4,820,441

[45] Date of Patent: Apr. 11, 1989

[54] PROCESS FOR THE PREPARATION OF A GRANULAR DETERGENT COMPOSITION

[75] Inventors: Elfed H. Evans, Clwyd, Wales; Peter C. Knight, South Wirral, England

[73] Assignee: Lever Brothers Company, New York, N.Y.

[21] Appl. No.: 187,757

[22] Filed: Apr. 29, 1988

[30] Foreign Application Priority Data

Apr. 30, 1987 [GB] United Kingdom ..... 8710291

[51] Int. Cl.[4] ..... C11D 3/22

[52] U.S. Cl. ..... 252/174.18; 252/135; 252/174.14; 252/174.21; 252/174.24; 252/527; 252/530; 252/546

[58] Field of Search ..... 252/527, 174.14, 174.18, 252/135, 530, 540, 174.21, 174.24, 546

[56] References Cited

U.S. PATENT DOCUMENTS 4,243,544 1/1981 Taylor ..... 252/135

FOREIGN PATENT DOCUMENTS 221776 5/1987 European Pat. Off. .
2013707 8/1979 United Kingdom .
2109398 6/1983 United Kingdom .
2159530 12/1985 United Kingdom .

*Primary Examiner*—Paul Lieberman
*Assistant Examiner*—Hoa Van Le
*Attorney, Agent, or Firm*—Milton L. Honig

[57] ABSTRACT

Granular spray-dried detergent compositions containing a crystal-growth-modified carbonate-based structurant salt are produced by a process in which separate slurries of the structurant salt and of the main detergent composition are prepared in different vessels, then mixed and spray-dried. The structural salt is preferably the sodium carbonate/sodium sulphate double salt Burkeite, crystal-growth-modified by means of a polymeric polycarboxylate.

9 Claims, No Drawings

PROCESS FOR THE PREPARATION OF A GRANULAR DETERGENT COMPOSITION

TECHNICAL FIELD OF INVENTION

The present invention relates to a process for the preparation of granular detergent compositions containing a porous crystal-growth-modified carbonate salt, as described and claimed in EP No. 221 776A (Unilever). The invention is of especial applicability to the production of detergent powders containing reduced or zero levels of inorganic phosphate.

BACKGROUND AND INTRODUCTION

Conventional detergent powders contain relatively large quantities of sodium tripolyphosphate (STP). This material is an excellent detergency builder because of its calcium binding power, and in spray-dried powders it also plays another important role: the intermeshing small needle-like crystals of STP hexahydrate provide an excellent matrix for the powder, capable of holding labile ingredients and forming the basis of a powder having excellent flow properties, low compressibility and low tendency to cake. In recent years environmental objections to inorganic phosphates in waste waters have prompted detergent manufacturers to replace STP wholly or partially by non-phosphate builders such as sodium carbonate, sodium nitrilotriacetate or sodium aluminosilicate, but these materials do not, in general, possess an ability comparable to that of STP to contribute to the structure of a spray-dried powder.

EP No. 221 776A (Unilever), published on May 13, 1987, describes and claims novel porous materials consisting of small crystals, comparable to those of STP, interspersed with small pores. One such material, crystal-growth-modified Burkeite, is prepared by drying (preferably spray-drying) a slurry containing sodium carbonate and sodium sulphate in an appropriate ratio and a crystal growth modifier, added to the slurry not later than the sodium carbonate so as to influence the growth of crystals of the double salt Burkeite. The use of crystal-growth-modified Burkeite as the base for a spray-dried detergent powder is described, for example, in Examples 16–23 of the aforementioned European specification. Example 23 describes a powder containing STP as the principal builder and structurant. The powder of Example 23 was prepared by slurrying together all ingredients and spray-drying.

It has now been discovered that spray-dried detergent powders containing crystal-growth-modified Burkeite or similar materials display better particle structure if produced by a method involving the preparation of two separate slurries. Powders containing STP show an additional benefit in that breakdown of STP during spray-drying is also reduced when the method of the present invention is used.

PRIOR ART

GB No. 2 013 707B (Unilever) discloses a process for preparing a powdered detergent composition comprising the steps of forming a detergent slurry in a mixing vessel, passing the slurry in a stream to a spray-nozzle and spray-drying the slurry, wherein an aqueous solution or suspension of sodium silicate is admixed with the stream of detergent slurry after it leaves the slurry mixing vessel and before spray-dried particles leave the spray nozzle. The detergent slurry contains sodium aluminosilicate detergency builder and the process reduces the adverse reaction between aluminosilicate and silicate to form insoluble siliceous species.

DEFINITION OF THE INVENTION

The present invention provides a process for the preparation of a granular detergent composition, which comprises the steps of:

(i) preparing a first aqueous slurry in a first vessel, the slurry comprising sodium carbonate, optionally together with sodium sulphate and/or sodium bicarbonate, and an effective amount of a crystal growth modifier which is an organic material having at least three carboxyl groups in the molecule, the crystal growth modifier being incorporated in the slurry not later than the sodium carbonate;

(ii) preparing a second aqueous slurry in a second vessel, the slurry comprising one or more anionic and/or nonionic surfactants, optionally one or more detergency builders and optionally one or more further heat-insensitive detergent components, (iii) mixing the first and second slurries and spray-drying the resulting mixed slurry to form a powder including a crystal-growth-modified carbonate-based salt.

For convenience, the first slurry will be referred to hereinafter as the carbonate slurry, and the second slurry as the base powder slurry.

DESCRIPTION OF THE INVENTION

The present invention is directed to a preferred method for preparing detergent powders which contain a porous carbonate-based crystal-growth-modified salt, as described and claimed in the aforementioned EP No. 221 776A (Unilever).

Three different porous carbonate-based crystal-growth-modified salts are of especial interest: sodium carbonate itself, mainly in monohydrate form but containing some anhydrous material; sodium sesquicarbonate, which is a hydrated carbonate/bicarbonate double salt of the formula $$Na_2CO_3.NaHCO_3.2H_2O;$$

and Burkeite, an anhydrous carbonate/sulphate double salt of the formula $$2Na_2SO_4.Na_2CO_3.$$

All three salts exhibit crystal growth modification, when prepared by drying a slurry containing the appropriate salt(s) and a crystal growth modifier added to the slurry not later than the sodium carbonate. The crystal growth modified materials are characterised by small needle-like crystals interspersed with very small pores, and are very useful structurants in detergent powders.

The sodium carbonate/sodium sulphate double salt Burkeite represents an especially preferred embodiment of the invention. This material forms small crystals (about 10 $\mu$m) but in the normal block-like crystal form these are packed together in dense aggregates and the material has a low absorptivity for liquids. As explained in the aforementioned EP No. 221 776A (Unilever), Burkeite can be converted to a more desirable needle-shaped crystal form in the slurry by the addition of a low level of a polycarboxylate material at a particular stage in the slurry-making process. Crystal-growth-modified spray-dried Burkeite contains small needle-shaped crystals similar to those of sodium tripolyphosphate hexahydrate, and can be shown by mercury porosimetry to be interspersed to a large extent with very small (<3.5 μm) pores. This material is capable of absorbing and retaining substantial quantities of mobile organic detergent components as a direct result both of a change in crystal form and of a less dense form of crystal packing, giving particles of greater porosity than those produced in the absence of a crystal growth modifier. The modified crystal structure can be recognised by optical or electron microscopy.

In the process of the invention, the modified crystals are allowed to grow in the first slurry, and need not encounter the base powder components until shortly before spray-drying. Similarly the crystal structures of the materials in the base powder slurry, notably STP, are allowed to develop separately. Different slurry-making conditions for each slurry can be chosen without the need to compromise.

The two slurries are prepared in separate vessels, and then mixed before they are conveyed to the spray nozzle of a spray-drying tower. Suitably they are fed simultaneously to a holding vessel where mixing takes place, and the mixture is then conveyed in the normal manner, via low-pressure and high-pressure lines, to the distribution manifold of the tower, and thence to the spray nozzle for atomisation and drying. If desired, the slurries may be kept separate until they reach the distribution manifold.

The relative quantities of the two slurries used may easily be chosen such that the resulting spray-dried powder contains the various ingredients in the desired proportions. A carbonate-based structurant salt content in the spray-dried powder of from 5 to 75% by weight, preferably from 10 to 50% by weight, is suitable having regard to the amount of other structurants present in the powder.

THE CARBONATE SLURRY

The carbonate slurry contains, as essential ingredients, sodium carbonate, water and a polycarboxylate crystal growth modifier. Optionally sodium sulphate and/or sodium bicarbonate may be present depending on the porous salt desired. Minor amounts of other materials may also be included as explained below.

It is essential that the polycarboxylate crystal growth modifier be present in the slurry at a sufficiently early stage to influence the crystal growth of the carbonate salt. It must accordingly be incorporated in the slurry not later than the time at which the sodium carbonate is added. If sodium sulphate and/or sodium bicarbonate is or are present, the crystal growth modifier is preferably incorporated not later than the addition of both the sodium carbonate and the other salt(s).

In batch slurry-making, there is no difficulty in arranging for the ingredients to be added in the appropriate order. In continuous slurry-making processes all components are added substantially simultaneously, but once the start-up period is over the inorganic salts will in practice always encounter a slurry containing some crystal growth modifier.

The water used to prepare the carbonate slurry is preferably relatively soft. Desirably water of hardness not exceeding 15° (French) is used.

The sodium carbonate used in the carbonate slurry may be of any type. Synthetic light soda ash has been found to be especially preferred; natural heavy soda ash is intermediate, while synthetic granular soda ash is the least preferred raw material. All grades of sodium sulphate are suitable for use in the invention, provided that they are not heavily contaminated with other salts such as salts of calcium or magnesium.

If the porous salt is Burkeite, the extent of its formation in the slurry will of course depend on the ratio of sodium carbonate and sodium sulphate present. This must be at least 0.03:1 (by weight) in order for the resulting spray-dried material to have a useful level of porosity; and it is preferably at least 0.1:1 and more preferably at least 0.37:1, this latter figure representing the stoichiometric ratio for Burkeite formation. Thus it is preferred that as much as possible of the sodium sulphate present be in the form of Burkeite. Any excess sodium carbonate present will itself be in a crystal-growth-modified form.

The stoichiometric weight ratio for sodium sesquicarbonate formation (sodium carbonate:sodium bicarbonate) is 1.26:1. During spray-drying some dehydration of sesquicarbonate occurs, to produce bicarbonate and carbonate; and some decomposition of bicarbonate to carbonate occurs. Furthermore crystallisation in the slurry may not always be complete, so the yield of sesquicarbonate may be as low as 50% of theoretical. Preferably the weight ratio of sodium carbonate to sodium bicarbonate used in preparing a sesquicarbonate slurry is within the range of from 1.5:1 to 1:1.

The preferred order of addition of the salts to a Burkeite slurry is for sodium sulphate to be added before sodium carbonate. This has been found to give a higher yield of Burkeite and the Burkeite thus formed appears to have a higher useful porosity. In this preferred method, the crystal growth modifier should be added to the slurry either before the addition of both salts, or after the addition of the sodium sulphate and before the addition of the sodium carbonate.

Similar considerations apply to the use of crystal-growth-modified sodium sesquicarbonate.

The polycarboxylate crystal growth modifier is an organic material containing at least three carboxyl groups in the molecule but we have found that it cannot be generically defined further in purely structural terms; it is also difficult to predict how much will be required. It can, however, be defined functionally with reference to Burkeite crystal growth modification, as an organic material having three or more carboxyl groups in the molecule, which, when incorporated at a suitable level in a slurry to which sodium carbonate and sodium sulphate in a weight ratio of at least 0.03:1 are subsequently or simultaneously added, gives on drying a powder having a pore size distribution, as measured by mercury porosimetry, of at least 300 $cm^3$ of pores <3.5 μm per kg of powder.

This porosity figure, measured by the recognised technique of mercury porosimetry, has been found to correlate well with the capacity to take up and retain mobile detergent components and to provide powder structuring.

For the purposes of selecting a crystal growth modifier on the basis of pore size distribution, it is necessary to use a simple slurry containing only sodium sulphate, sodium carbonate, the crystal growth modifier and water, because the presence of other materials will influence the porosity. This model system can then be used to select a crystal growth modifier for use in more complex slurries where other materials may be present, and/or for use in modifying the crystal growth of other carbonate salts, for example, sodium carbonate itself or sodium sesquicarbonate.

As hinted above, the carbonate slurry for use in the process of the present invention may advantageously contain minor amounts of other components. A small amount of anionic surfactant, for example, increases slurry stability, and a small amount of nonionic surfactant improves slurry pumpability.

The crystal growth modifier is a polycarboxylate. Monomeric polycarboxylates, for example, salts of ethylenediaminetetraacetic acid, nitrilotriacetic acid and citric acid, may be used but the levels required are rather high, for example, 5 to 10% weight based on the total amount of sodium carbonate and, if present, sodium sulphate and/or sodium bicarbonate. Preferred polycarboxylate crystal growth modifiers used in the invention are polymeric polycarboxylates. Amounts of from 0.1 to 20% by weight, preferably from 0.2 to 5% by weight, based on the total amount of sodium carbonate and, if present, sodium sulphate and/or sodium bicarbonate, are generally sufficient.

The polycarboxylate crystal growth modifier preferably has a molecular weight of at least 1000, advantageously from 1000 to 300 000, especially from 1000 to 250 000. Powders having especially good dynamic flow rates may be prepared if the carbonate slurry incorporates polycarboxylate crystal growth modifiers having molecular weights in the 3000 to 100 000 range, especially 3500 to 70 000 and more especially 10 000 to 70 000. All molecular weights quoted herein are those provided by the manufacturers.

Preferred crystal growth modifiers are homopolymers and copolymers of acrylic acid or maleic acid. Of especial interest are polyacrylates, acrylic acid/maleic acid copolymers, and acrylic phosphinates.

Suitable polymers, which may be used alone or in combination, include the following:

salts of polyacrylic acid such as sodium polyacrylate, for example Versicol (Trade Mark ) E5 E7 and E9 ex Allied Colloids, average molecular weights 3500, 27 000 and 70 000; Narlex (Trade Mark) LD 30 and 34 ex National Adhesives and Resins Ltd, average molecular weights 5000 and 25 000 respectively; Acrysol (Trade Mark) LMW-10, LMW-20, LMW-45 and A-IN ex Rohm & Haas, average molecular weights 1000, 2000, 4500 and 60 000; and Sokalan (Trade Mark) PAS ex BASF, average molecular weight 250 000;

ethylene/maleic acid copolymers, for example, the EMA (Trade Mark) series ex Monsanto;

methyl vinyl ether/maleic acid copolymers, for example, Gantrez (Trade Mark) AN119 ex GAF Corporation;

acrylic acid/maleic acid copolymers, for example, Sokalan (Trade Mark) CP5 and CP7 ex BASF; and acrylic phosphinates, for example, the DKW range ex National Adhesives and Resins Ltd or the Belsperse (Trade Mark) range ex Ciba-Geigy AG, as disclosed in EP No. 182 411 A (Unilever).

Mixtures of any two or more crystal growth modifiers may if desired be used in the compositions of the invention.

The carbonate slurry will generally contain from 45 to 60% by weight of water.

As indicated previously, slurry-making conditions may be chosen to maximise the yield of modified crystals obtained. Sodium carbonate and Burkeite slurries are best prepared at relatively high temperatures, preferably above 80° C., more preferably from 85° to 95° C.; while a sodium sesquicarbonate slurry is best prepared at a temperature not exceeding 65° C., preferably from 50° to 60° C., in order to minimise decomposition of the sodium bicarbonate present.

A high pH can be detrimental to good crystal formation of sodium sesquicarbonate, and the process of the invention has the further advantage when this structurant is used that any sodium alkaline silicate or other strongly alkaline components of the powder can be included in the base powder slurry and will not be encountered by the sesquicarbonate until the crystal growth of the latter in the slurry is complete.

On drying a slurry containing crystal-growth-modified Burkeite, which is an anhydrous material, the double salt survives unchanged in the dried powder. Crystal-growth-modified sodium carbonate monohydrate and sodium sesquicarbonate will generally lose some water of crystallisation on drying, depending on the drying conditions, but this does not adversely affect the structurant properties.

THE BASE POWDER SLURRY

The base powder slurry will generally contain all ingredients desired in the final product that are sufficiently heat-stable to undergo spray-drying. It will always contain one or more anionic and/or nonionic surfactants, and will generally include one or more detergency builders.

Anionic surfactants are well known to those skilled in the detergents art. Examples include alkylbenzene sulphonates, particularly sodium linear $C_8$–$C_{15}$ alkylbenzene sulphonates having an average chain length of $C_{11}$–$C_{13}$; primary and secondary alcohol sulphates, particularly sodium $C_{12}$–$C_{15}$ primary alcohol sulphates; olefin sulphonates; alkane sulphonates; and fatty acid ester sulphonates.

It may also be desirable to include one or more soaps of fatty acids. The soaps which can be used are preferably sodium soaps derived from naturally occurring fatty acids, for example the fatty acids from coconut oil, beef tallow, sunflower or hardened rapeseed oil.

The base powder slurry may also include one or more nonionic surfactants. Examples of suitable nonionic surfactants are the primary and secondary alcohol ethoxylates, especially the $C_{12}$–$C_{15}$ primary and secondary alcohols ethoxylated with an average of from 5 to 20 moles of ethylene oxide per mole of alcohol.

The sodium carbonate present in the carbonate-based structurant material acts as a detergency builder, but may not be present in a sufficient amount to provide adequate building. Preferred builders for inclusion in the base powder slurry include phosphates, for example, orthophosphates, pyrophosphates and (most preferably) tripolyphosphates. Non-P builders that may be present include, but are not restricted to, sodium carbonate, crystalline and amorphous aluminosilicates, soaps, sulphonated fatty acid salts, citrates, nitrilotriacetates and carboxymethyloxsuccinates. Polymeric builders, for example, polycarboxylates such as polyacrylates, acrylic/maleic copolymers and acrylic phosphinates, may also be present, generally but not exclusively to supplement the effect of another builder such as sodium tripolyphosphate or sodium aluminosilicate. The polymers listed previously as crystal growth modifiers generally have builder efficacy and any of these may with advantage also be included in the base powder slurry.

Other ingredients that may be present in the base powder slurry include alkali metal silicates, antiredeposition agents, antiincrustation agents and fluorescers.

The water content of the base powder slurry will typically be in the range of from 30 to 55% by weight, preferably from 35 to 50% by weight.

PREFERRED EMBODIMENTS OF THE INVENTION

According to the preferred embodiment of the invention, the base powder slurry contains sodium tripolyphosphate (STP), preferably in an amount of from 5 to 30% by weight, more preferably from 10 to 30% by weight, based on the spray-dried powder.

The sodium tripolyphosphate may be the only builder present apart from the sodium carbonate contributed by the porous structurant salt, or it may form part of a mixed builder system with, for example, sodium aluminosilicate, sodium nitrilotriacetate or a polymeric builder. The invention is of especial interest for the production of powders containing relatively low levels (25% or less) of STP, in which additional structuring is especially important.

Since the carbonate and base powder slurries are prepared separately, a base powder slurry containing STP can be prepared under conditions that favour the growth of small, fully hydrated STP hexahydrate crystals, without any need to consider whether or not the crystal growth of the carbonate-based structurant salt is equally favoured. The preferred temperature for optimum STP crystal development is below 90° C., preferably from 60° to 80° C.: it will be seen that this is lower than the preferred temperature for processing Burkeite or sodium carbonate slurries but higher than the preferred temperature for processing sodium sesquicarbonate slurries, so the preparation of separate slurries avoids the need for a compromise or temperature.

It is also advantageous for a base powder slurry containing STP to contain a relatively low level of other inorganic salts, preferably less than 15%, more preferably less than 10%, based on the spray-dried powder.

In this embodiment of the invention, a further benefit has been found: the amount of breakdown of STP to orthophosphate and pyrophosphate during spray-drying is reduced, as compared with powders of identical composition prepared from a single slurry. Reduced STP breakdown leads to decreased deposition of calcium pyrophosphate ash on washed fabrics, descreased soil redeposition during the wash, and improved enzyme efficacy.

In a second preferred embodiment of the invention, the base powder slurry includes crystalline or amorphous aluminosilicate builder. This second embodiment is especially applicable to the preparation of zero-phosphate detergent powders. Aluminosilicates are not good structurants, and the use of a supplementary structurant is very beneficial.

OPTIONAL POST-TREATMENTS

The spray-dried powder produced by the process of the invention may be useful in its own right as a detergent powder. Alternatively, various additional ingredients that are unsuitable for slurry-making and spray-drying may be added subsequently.

Since the crystal-growth-modified structurant salts are highly absorbent and have excellent carrier properties for mobile liquid detergent components, such components that are unsuitable for spray-drying may advantageously be sprayed onto the spray-dried powder. The term "liquid detergent component" includes components that require liquefaction by melting or dissolving in a solvent, as well as materials liquid at room temperature. The liquid component is preferably applied to the spray-dried powder by spraying while the powder is agitated in apparatus, for example, a rotating drum, that continually provides a changing surface of powder to the sprayed liquid. The spray nozzle is advantageously angled so that liquid that penetrates the powder curtain falls on further powder rather than the shell of the drum itself.

During the spraying process the temperature of the powder may range, for example, from 30° to 95° C. The powder generally leaves the spray-drying tower at an elevated temperature, and this may be advantageous when the component to be sprayed on has to be melted.

Components that may be sprayed on to the spray-dried powder include in particular nonionic surfactants having an average degree of ethoxylation of 10 or below, which are generally liquid at room temperature and often cannot be spray-dried because they give rise to unacceptable levels of tower emission ("blue smoke" or "pluming").

Other ingredients that may be sprayed on include lather suppressors and perfumes.

It will also generally be desirable to add to the spray-dried powder various further ingredients that are not suitable for spray-drying or that interfere with the spray-drying process. Examples of such ingredients are enzymes; bleaches, bleach precursors, or bleach activators; inorganic salts such as sodium sulphate, as described and claimed in EP No. 219 328A (Unilever); or sodium silicate as described and claimed in our copending Applications Nos. 86 08291 filed on Apr. 4, 1986 and 86 09042 and 86 09043 filed on Apr. 14, 1986; lather suppressors; perfumes; dyes; coloured noodles or speckles. Further examples of ingredients best incorporated by postdosing will readily suggest themselves to the skilled detergent formulator.

PRODUCTS OF THE INVENTION

Phosphate-built powders prepared in accordance with the invention may typically contain the following amounts of the following ingredients:

| | weight % |
|---|---|
| Surfactants (anionic, nonionic, cationic, zwitterionic) | 5–40 |
| Sodium tripolyphosphate | 5–40 |
| Sodium carbonate (in structurant salt) | 1–25 |
| Sodium carbonate (other) | 0–10 |
| Sodium sulphate or sodium bicarbonate (in structurant salt) | 0–25 |
| Sodium sulphate (other) | 0–30 |
| Crystal growth modifier (polymeric polycarboxylate) | 0.05–5 |
| Sodium silicate | 0–15 |
| Bleach ingredients | 0–30 |
| Enzyme, lather suppressor etc | 0–10 |

Low or zero-phosphate aluminosilicate-built powders prepared in accordance with the invention may typically contain the following amounts of the following ingredients:

| | weight % |
|---|---|
| Surfactants (anionic, nonionic, cationic, zwitterionic) | 5–40 |
| Sodium aluminosilicate | 10–60 |
| Sodium tripolyphosphate | 0–25 |
| Sodium orthophosphate | 0–20 |

-continued

| | weight % |
|---|---|
| Sodium nitrilotriacetate | 0–20 |
| Sodium carbonate (in structurant salt) | 1–25 |
| Sodium carbonate (other) | 0–10 |
| Sodium sulphate or sodium bicarbonate (in structurant salt) | 0–25 |
| Sodium sulphate (other) | 0–30 |
| Crystal growth modifier (polymeric polycarboxylate) | 0.05–10 |
| Sodium silicate | 0–10 |
| Bleach ingredients | 0–30 |
| Enzyme, lather suppressor etc | 0–10 |

EXAMPLES

The invention is illustrated by the following non-limiting Examples, in which parts and percentages are by weight unless otherwise stated.

EXAMPLE 1

In this experiment, a 1000 kg batch of slurry was prepared by the method of the invention, and spray-dried to form a powder (Example 1); and a 500 kg batch of slurry of the same composition was prepared by a single-slurry method and spray-dried to form a powder (Comparative Example A).

To prepare the powder of Example 1, a Burkeite slurry was first prepared from the following ingredients in the order listed:

| | kg |
|---|---|
| Softened water | 250.0 |
| Sodium polyacrylate solution (25% w/w) | 27.0 |
| Sodium sulphate | 162.0 |
| Sodium carbonate (light soda ash ex ICI) | 61.0 |
| | 500.0 |

The percentage of sodium polyacrylate, based on the total amount of sodium carbonate and sodium sulphate, was 3%; the ratio of sodium carbonate to sodium sulphate was 0.37:1 (stoichiometric for Burkeite formation).

The slurry was heated to 90° C. after the addition of the sodium sulphate but before the addition of the sodium carbonate. When all ingredients had been added, the slurry was stirred thoroughly.

In a second vessel, a base powder slurry was prepared from the following ingredients in the order listed:

| | kg |
|---|---|
| Softened water at 65° C. | 270.0 |
| Sodium alkylbenzene sulphonate (48% w/w) | 63.0 |
| Sodium alkaline (2.0r) silicate solution (48% w/w) | 59.0 |
| Sodium EDTA solution (40% w/w) | 1.2 |
| Fluorescer slurry (32% w/w) | 4.4 |
| Sodium carboxymethyl cellulose | 2.1 |
| Nonionic surfactant | 4.8 |
| Sodium tripolyphosphate (35% Phase I) | 95.0 |
| | 500.0 |

When all the ingredients had been added, the base powder slurry was stirred for a further 5 minutes.

The Burkeite slurry and the base powder slurry were dropped successively into a stirred holding vessel and the mixture was stirred for 10 minutes.

The mixed slurry was then spray-dried at a pressure of 45 bar through a 3 mm hollow cone swirl nozzle into a spray-drying tower. Hot air at 390° C. was used to dry the slurry to give a powder having a moisture content of about 10%. The compositions of the final slurry and of the powder are shown in Table 1.

The control powder A was prepared by spray-drying a single slurry prepared from the following ingredients in the order listed:

| | kg |
|---|---|
| Softened water at 90° C. | 130.0 |
| Sodium polyacrylate solution (25% w/w) | 13.5 |
| Sodium sulphate | 81.0 |
| Sodium carbonate | 30.5 |
| Softened water at 15° C. | 130.0 |
| Sodium ABS (45% w/w) | 31.5 |
| Sodium alkaline silicate (48% w/w) | 29.5 |
| EDTA (40% w/w) | 0.6 |
| Fluorescer (32% w/w) | 2.2 |
| Nonionic surfactant | 2.4 |
| Sodium tripolyphosphate | 47.5 |
| | 500.0 |

The ingredients were identical to those used to prepare the powder of Example 1. The slurry was spray-dried under identical conditions, to give a powder of the same composition, as shown in Table 1.

TABLE 1

| | 1 Total slurry (kg) | A Total slurry (kg) | 1, A Powder (% w/w) |
|---|---|---|---|
| Sodium polyacrylate | 6.75 | 3.38 | 1.56 |
| Sodium sulphate | 162.00 | 81.00 | 37.36 |
| Sodium carbonate | 61.00 | 30.50 | 14.07 |
| Sodium ABS | 28.35 | 14.18 | 6.54 |
| Sodium silicate | 28.32 | 14.16 | 6.53 |
| EDTA | 0.48 | 0.24 | 0.11 |
| Fluorescer | 1.41 | 0.70 | 0.33 |
| SCMC | 2.10 | 1.05 | 0.48 |
| Nonionic surfactant | 4.80 | 2.40 | 1.11 |
| STP | 95.00 | 47.50 | 21.91 |
| Water, moisture | to 1000 | to 500 | 10.00 |
| | | | 100.00 |

The dynamic flow rates of the powders were as follows:

| | |
|---|---|
| Example 1 | 112 ml/s |
| Comparative Example A | 101 ml/s |

Analysis of both powders showed STP breakdown as follows:

| | 1 | A |
|---|---|---|
| Tripolyphosphate (%) | 91.0 | 83.6 |
| Pyrophosphate (%) | 6.4 | 13.2 |
| Orthophosphate (%) | 2.6 | 3.2 |
| | 100.0 | 100.0 |

Thus the powder prepared according to the invention showed better flow properties, reflecting its superior structure, and reduced STP breakdown.

EXAMPLES 2–4

These examples illustrate the use of the process of the invention in the preparation of zero-P powders built with zeolite.

A Burkeite slurry was prepared from the following ingredients in the order listed, at a temperature of 90° C.:

| | Parts |
|---|---|
| Softened water | 22.0 |
| Sodium polyacrylate | 0.37 |
| Sodium sulphate | 11.4 |
| Sodium carbonate | 6.9 |
| | 40.67 |

The percentage of sodium polyacrylate, based on the total amount of sodium carbonate and sodium sulphate, was 2%; the ratio of sodium carbonate to sodium sulphate was 0.60, greater than that required for Burkeite formation, so that the eventual product contained both polymer-modified Burkeite and polymer-modified sodium carbonate monohydrate.

In a second vessel, a base powder slurry was prepared from the following ingredients in the order listed and at a temperature of 85° C.:

| | Parts |
|---|---|
| Water | 66.0 |
| Sodium alkylbenzene sulphonate | 12.0 |
| Nonionic surfactant | 3.0 |
| Soap | 2.0 |
| Zeolite HAB A40 | 30.0 |
| Polymer* | 2.7 |
| Sodium sulphate | 19.2 |
| SCMC | 0.35 |
| | 135.25 |

*Acrylic/maleic copolymer; Sokalan (Trade Mark) CP5 ex BASF

The first and second slurries were mixed for 10 minutes, then transferred to a stirred mixing vessel and the mixture stirred for a further 10 minutes.

Batches of the combined slurry were spray-dried under conditions similar to those in the previous Example, the conditions being adjusted to produce powders having a range of moisture contents. The composition of the spray dried powder was as follows:

| | Parts |
|---|---|
| Sodium alkylbenzene sulphonate | 12.0 |
| Nonionic surfactant | 3.0 |
| Soap | 2.0 |
| Zeolite HAB A40 | 30.0 |
| Polymer (Sokalan CP5) | 2.7 |
| Sodium polyacrylate | 0.37 |
| Sodium sulphate | 30.6 |
| Sodium carbonate | 6.9 |
| SCMC | 0.35 |
| Water (nominal) | 9.08 |
| | 97.0 |

Control powders were prepared by spray drying batches of a single slurry in which the ingredients of the base powder slurry were first mixed, followed by addition of the ingredients of the Burkeite slurry.

The properties of the powders at different moisture contents were as follows:

| Moisture content (%) | 2<br>5% | 3<br>8% | 4<br>10% | B<br>5% | C<br>8% | D<br>10% |
|---|---|---|---|---|---|---|
| Bulk density (g/l) | 450 | 410 | 430 | 380 | 380 | 400 |
| Dynamic flow rate (ml/s) | 86 | 92 | 86 | 83 | 86 | 80 |
| Compressibility (%) | 12 | 20 | 25 | 28 | 36 | 45 |
| Unconfined compression test (kg) (UCT) | 0.1 | 1.1 | 1.4 | 1.3 | 2.8 | 3.5 |

The powder properties, particularly the compressibility and UCT values, of the powders of Examples 2–4 were better that those of the corresponding control powders, and were less sensitive to changes in moisture content.

This makes control of the spray drying operation simpler and provides greater processing flexibility.

EXAMPLES 5–7

These Examples relate to the preparation of a different zeolite-built detergent powder.

A sodium carbonate/Burkeite slurry was prepared from the following ingredients in the order listed, at a temperature of 90° C.:

| | Parts |
|---|---|
| Softened water | 34.0 |
| Sodium polyacrylate | 0.2 |
| Sodium sulphate | 18.2 |
| Sodium carbonate | 10.0 |
| | 62.4 |

The percentage of sodium polyacrylate, based on the total amount of sodium carbonate and sodium sulphate, was 0.7%. The ratio of sodium carbonate to sodium sulphate was 0.55, so that, as in Examples 2–4, the slurry composition was such as to produce a mixture of polymer-modified Burkeite and polymer-modified sodium carbonate monohydrate.

In a second vessel, a base powder slurry was prepared from the following ingredients in the order listed and at a temperature of 85° C.:

| | Parts |
|---|---|
| Water | 39.0 |
| Sodium alkylbenzene sulphonate | 9.0 |
| Nonionic surfactant | 1.0 |
| Zeolite HAB A40 | 24.0 |
| Polymer (Sokalon CP5) | 4.0 |
| Minor ingredients | 0.83 |
| | 77.83 |

The first and second slurries were mixed for 10 minutes, then transferred to a stirred mixing vessel and the mixture stirred for a further 10 minutes.

Batches of the combined slurry were spray dried under conditions similar to those in previous Examples. The composition of the spray dried powder was as follows:

| | Parts |
|---|---|
| Sodium alkylbenzene sulphonate | 9.0 |
| Nonionic surfactant | 1.0 |
| Zeolite HAB A40 | 24.0 |
| Polymer (Sokalan CP5) | 4.0 |
| Sodium polyacrylate | 0.2 |
| Sodium sulphate | 18.2 |
| Sodium carbonate | 10.0 |

-continued

| | Parts |
|---|---|
| Minor ingredients | 0.83 |
| Water (nominal) | 7.0 |
| | 74.23 |

Batches of control powder of similar composition were prepared by spray-drying a single slurry produced by mixing all the ingredients.

The properties of the powders at different moisture contents were as follows:

| | 5 | 6 | 7 | E | F | G |
|---|---|---|---|---|---|---|
| Moisture content (%) | 6.0 | 10.0 | 13.0 | 6.0 | 10.0 | 13.0 |
| Bulk density (g/l) | 412 | 400 | 426 | 350 | 360 | 375 |
| Dynamic flow rate (ml/s) | 96 | 96 | 83 | 83 | 83 | 75 |
| Compressibility (5) | 7 | 27 | 37 | 15 | 43 | 45 |
| Unconfined Compression Test (UCT) (Kg) | 0.2 | 1.0 | 2.3 | 0.2 | 2.3 | 3.0 |

The powder properties, particularly the compressibility and UCT values, of the powders of Examples 5, 6 and 7 were better that thos of the corresponding control powders, and the properties were less sensitive to variations in powder moisture content.

We claim:

1. A process for the preparation of a granular detergent composition, which comprises the steps of:

(i) preparing a first aqueous slurry in a first vessel, the slurry comprising a carbonate-based salt selected from the group consisting of sodium carbonate monohydrate, hydrated sodium carbonate/sodium bicarbonate double salt, anhydrous sodium carbonate/sodium sulfate double salt, and mixtures thereof, and an effective amount of a crystal growth modifier which is an organic material having at least three carboxyl groups in the molecule, the crystal growth modifier being incorporated in the slurry not later than the sodium carbonate;

(ii) preparing a second aqueous slurry in a second vessel, the slurry comprising a surfactant selected from the group consisting of anionic surfactants, nonionic surfactants, and mixtures thereof;

(iii) mixing the first and second slurries and spray-drying the resultant mixed slurry to form a powder including a crystal-growth-modified carbonate-based salt.

2. A process as claimed in claim 1, wherein the first aqueous slurry comprises sodium carbonate and sodium sulphate in a weight ratio of sodium carbonate to sodium sulphate of at least 0.03:1, whereby the powder obtained in step (iii) includes crystal-growth-modified Burkeite.

3. A process as claimed in claim 1, wherein the first aqueous slurry comprises sodium carbonate and sodium bicarbonate, whereby the powder obtained in step (iii) includes crystal-growth-modified sodium sesquicarbonate.

4. A process as claimed in claim 1, wherein the first and second aqueous slurries are mixed in proportions such that the spray-dried powder produced in step (iii) contains from 5 to 75% by weight of crystal-growth-modified carbonate-based salt.

5. A process as claimed in claim 1, wherein the crystal growth modifier in the first aqueous slurry is a polymeric polycarboxylate having a molecular weight of from 1000 to 300,000, and is present in an amount of from 0.1 to 20% by weight based on the total amount of carbonate-based salt in the said slurry.

6. A process as claimed in claim 1, wherein the second aqueous slurry includes sodium tripolyphosphate.

7. A process as claimed in claim 6, wherein the second aqueous slurry contains from 5 to 30% by weight, based on the powder produced in step (iii), of sodium tripolyphosphate.

8. A process as claimed in claim 6, wherein the second aqueous slurry contains less than 15% by weight, based on the powder produced in step (iii), of inorganic salts other than sodium tripolyphosphate.

9. A process as claimed in claim 6, wherein the final composition contains less than 25% by weight of sodium tripolyphosphate.

* * * * *